United States Patent [19]

Jean

[11] Patent Number: 4,971,369

[45] Date of Patent: Nov. 20, 1990

[54] CLOSURE, PARTICULARLY DOOR, WITH PERIPHERAL BOLT

[75] Inventor: Michel Jean, Marcigny, France

[73] Assignee: Ets. Jean Etudes et Realisations Mettaliques, Marcigny, France

[21] Appl. No.: 492,896

[22] Filed: Mar. 13, 1990

[30] Foreign Application Priority Data

Mar. 14, 1989 [FR] France ..... 89 03571

[51] Int. Cl.[5] ..... E05C 9/04

[52] U.S. Cl. ..... 292/36; 49/395; 292/39

[58] Field of Search ..... 49/395 X; 292/32–43, 292/170

[56] References Cited

U.S. PATENT DOCUMENTS

| | | | |
|---|---|---|---|
| 141,874 | 8/1873 | Hall | 292/40 |
| 149,193 | 3/1874 | Briggs | 292/39 |
| 914,424 | 3/1909 | Kelly | 292/36 |
| 939,922 | 11/1909 | Myers et al. | 292/36 |
| 959,406 | 5/1910 | Unckrich | 292/36 |
| 1,035,531 | 8/1912 | Cobb | 292/39 |
| 1,288,455 | 12/1918 | Whartenby | 292/39 |
| 1,328,355 | 1/1920 | Arndt | 292/39 |
| 1,929,341 | 10/1933 | Wegner | 292/36 |

FOREIGN PATENT DOCUMENTS

| | | |
|---|---|---|
| 456764 | 9/1913 | France . |
| 2566043 | 12/1985 | France . |

*Primary Examiner*—Eric K. Nicholson
*Attorney, Agent, or Firm*—Dowell & Dowell

[57] ABSTRACT

A bolt assembly which includes four bars each cooperating with the corresponding edges of a closure wherein at least one of the horizontal bars is in the form of a hollow body having oppositely oriented slide elements resiliently mounted therein so that their free ends are urged against the ends of the adjacent vertical bars so as to prevent the formation of a gap in the joint between the horizontal and vertical bars in both their retracted and locked positions.

6 Claims, 4 Drawing Sheets

CLOSURE, PARTICULARLY DOOR, WITH PERIPHERAL BOLT

FIELD OF THE INVENTION

The present invention relates to a closure, particularly a door, with peripheral bolt.

BACKGROUND OF THE INVENTION

For various reasons, a closure such as a door has already been known to be provided with a peripheral bolt controlled from a central member, which bolt includes elements which, at rest, are located within the door, whilst, in locked position, they have undergone a translation bringing them into a depression made in the door frame.

For example, French Patent No. 456 764 of Apr. 16, 1913, discloses a system of the type in question which presents the drawback of not being continuous in the corners and at the lock. In addition, the system is complicated as it comprises a large number of hinges which renders its cost price very high.

In order to overcome the drawbacks of such a device, French Patent No. 2 566 040 provides a peripheral bolt constituted by four angle irons necessitating inserting therebetween four braces ensuring continuity of the bolt in locked position.

However, the closure system according to that document is complex, with the result that its prohibitive cost price eliminates any possibility of marketing it on a large scale.

The improvements forming the subject matter of the present invention aim at allowing a closure with peripheral bolt to be produced which, whilst ensuring a continuity of this bolt in locked position, may be made simply and economically.

SUMMARY OF THE INVENTION

To that end, the closure according to the invention includes a peripheral bolt which includes four bars each cooperating with a corresponding edge of the closure and which are characterized in that at least one of the horizontal bars is in the form of a hollow body having two opposite slide elements elastically mounted therein so that their free ends abut against the end of adjacent vertical bar so as to avoid the formation of a gap in the zone of the joint between the bars in their retracted and locked positions.

BRIEF DESCRIPTION OF THE DRAWINGS

The invention will be more readily understood on reading the following description with reference to the accompanying drawings, in which.

DETAILED DESCRIPTION OF THE DRAWINGS

Figure 1:
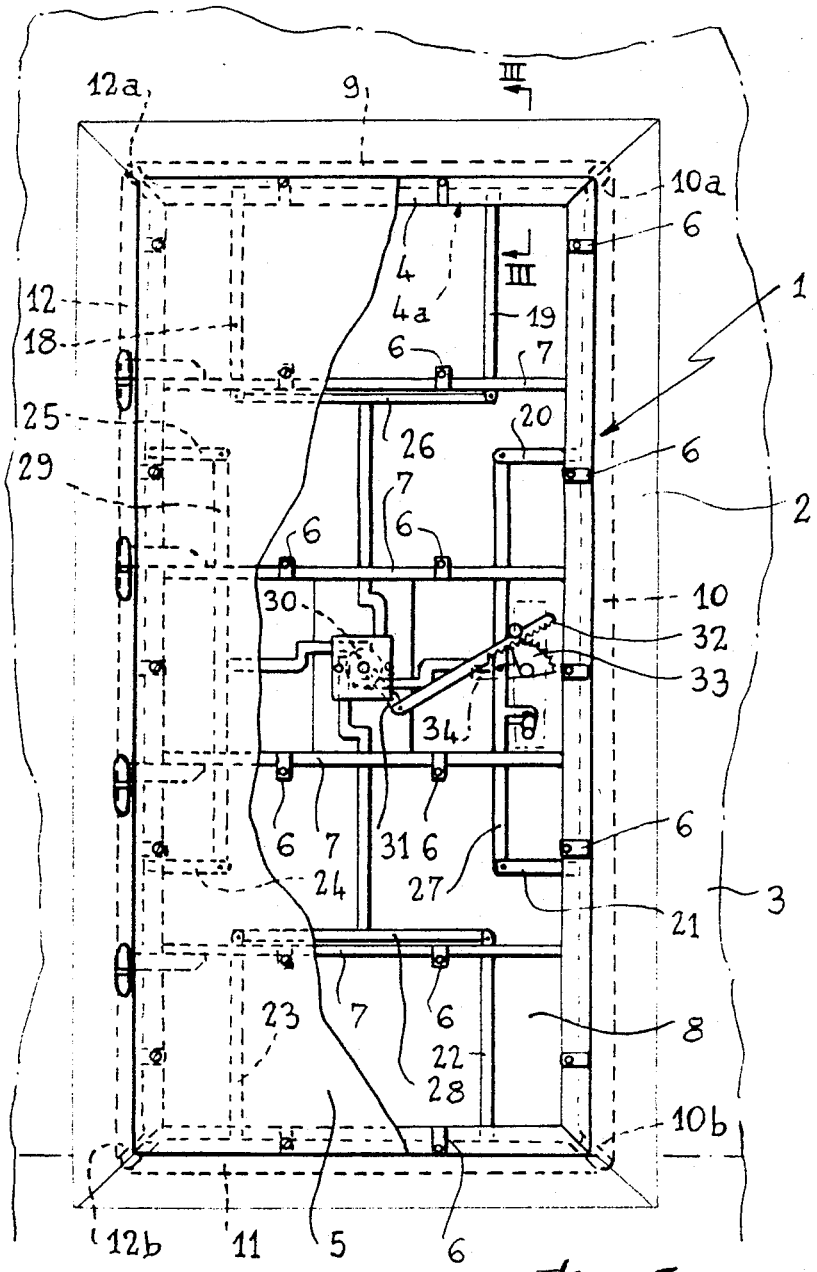
FIG. 1 is a view in elevation, with parts broken away, of a door made in accordance with the invention.

Referring now to the drawings, FIG. 1 illustrates the door 1 according to the invention, fitted in a frame 2 associated with a partition or wall 3.

The door frame 2 is constituted by an open section comprising a central or channel 2*a* which defines an inner peripheral groove 2*b*, said web extending inwardly of a face 2*c* constituting a tongue element: the latter and the other end of the central web are associated with two flanges 2*d*, 2*e* which form the lateral faces of the door frame.

As for door 1, it includes a peripheral section or channel 4 which extends inwardly of a throat 4*a* opening out on the total periphery of door 1. One of the raised edges of the channel 4 is associated with a panel 5 constituting the inside of the door and which is secured with respect to tabs 6 secured with crosspieces 7 of the door (FIG. 1). Panel 5 covers the cambered end of the corresponding raised edge of section 4. The second raised edge of the latter is joined to the periphery of a second panel 8 comprising a shoulder 8*a* which forms the conventional rabbet of the door adapted to cooperate with the tongue element 2*c* of the door frame.

In throat 4*a* and in each edge of door 1, there are disposed bars 9–12 respectively made in the form of a rectangular tube engaged for tight sliding engagement in the throat 4*a* of each of said edges of door 1.

Figure 4:
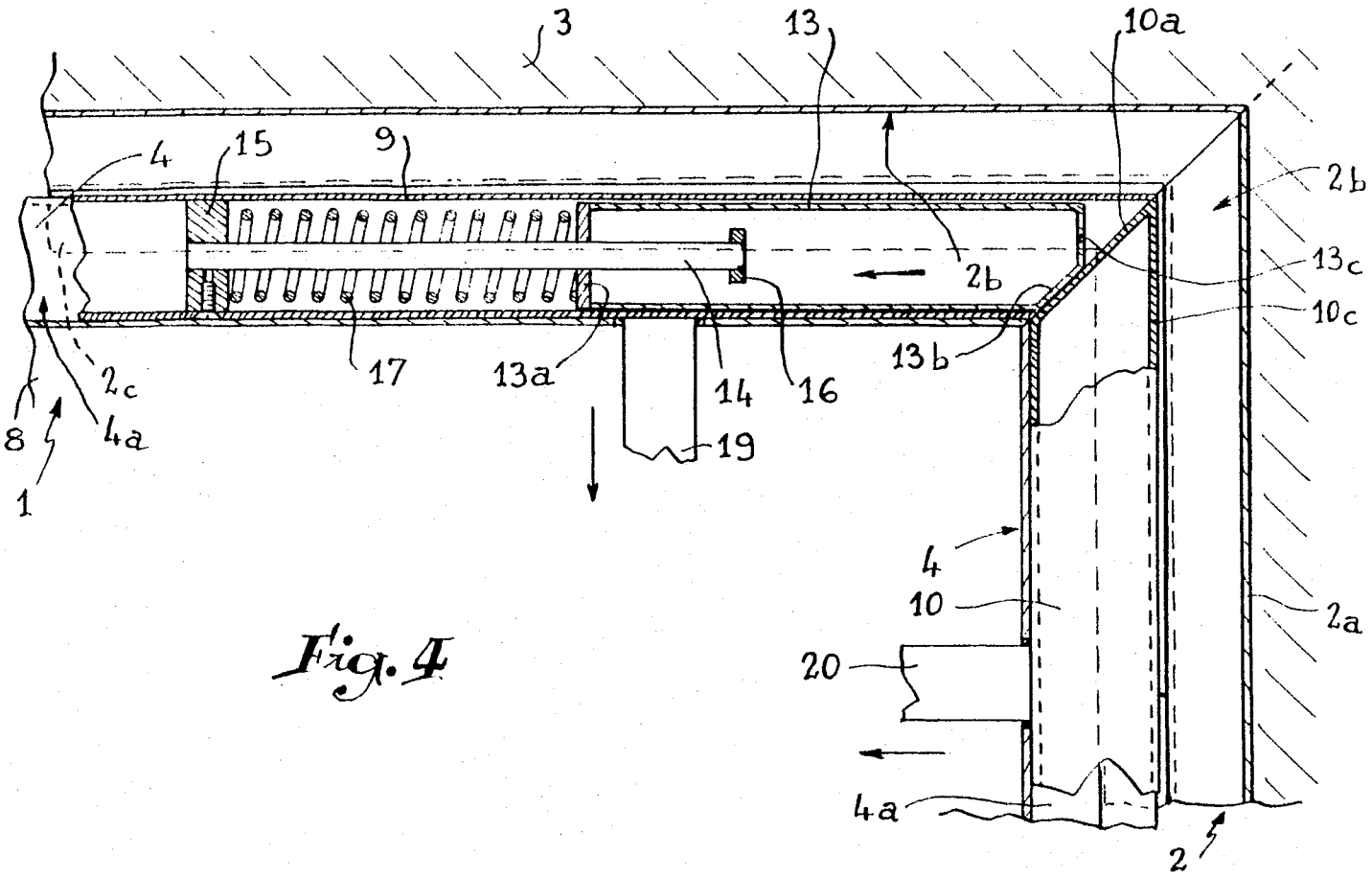
FIG. 4 shows in section the top right-hand corner of the door illustrated in FIG. 1 with the peripheral bolt in retracted position.
Figure 5:
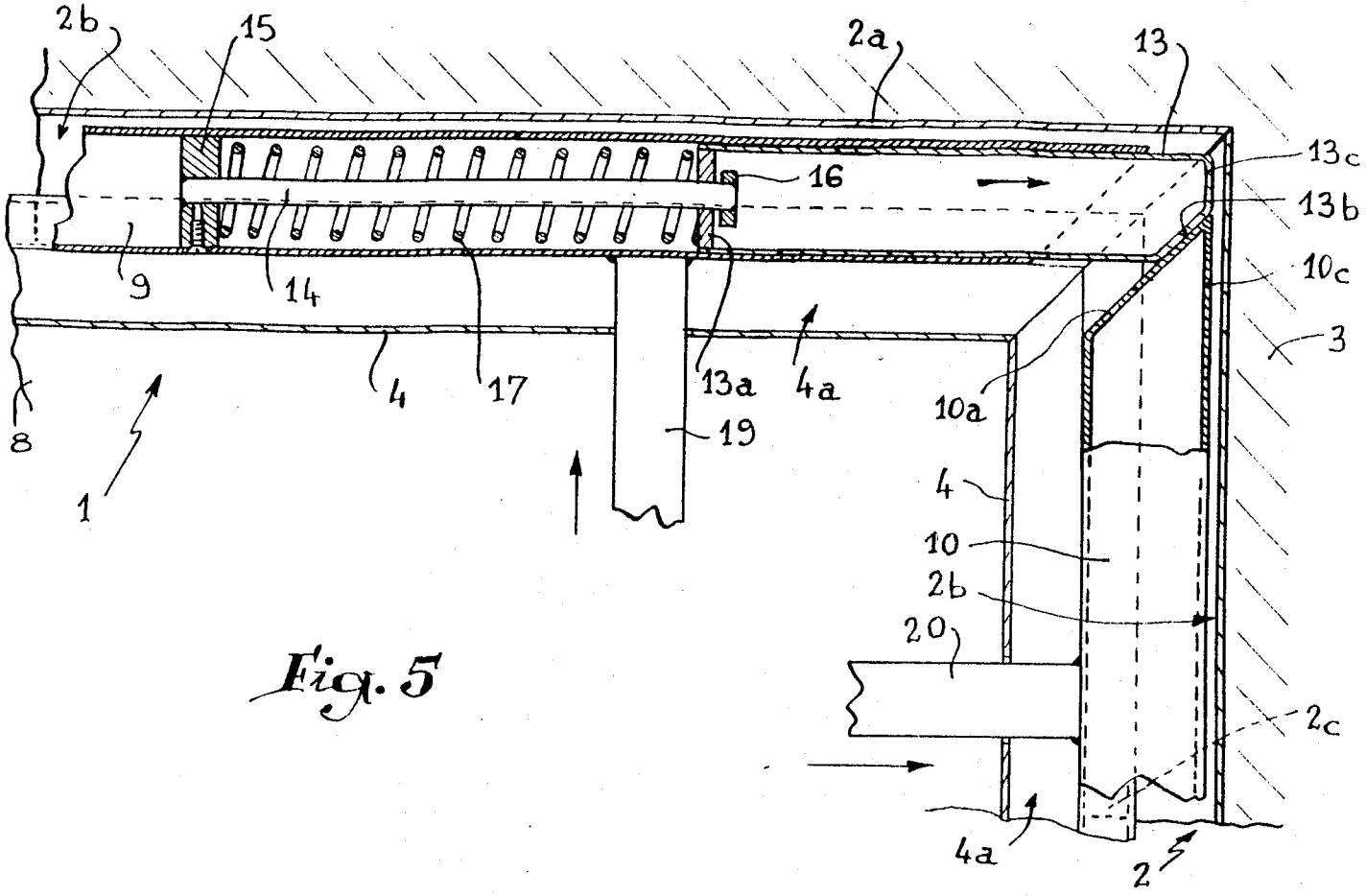
FIG. 5 is a view similar to that of FIG. 4, but showing the bolt in locked position. The plane of section III—III of FIG. 3 is shown in this Figure.

According to the invention, at least one of the horizontal bars 9, 11 is associated with two opposite slide elements 13 of which one is illustrated in FIG. 4. Each of the slide elements is in the form of a rectangular tube adapted to slide inside the corresponding bar 9, 11. Its inner end is provided with a small plate 13*a* which closes the tube and through which passes a rod 14 of which one of the ends is connected to a block 15 secured with the interior of the bar 13, whilst its other end bears a stop 16 disposed inside the slide element 13. Between plate 13*a* of the latter and block 15, there is mounted a compression spring 17 which urges the slide element 13 outwardly, so that its end opposite the one bearing plate 13*a* rests against the upper closed end 10*a* of the corresponding vertical bar 10. It will be observed that that end of the slide element 13 opposite plate 13*a* includes a bevel 13*b* which is in abutment against the closed end 10*a* of bar 10 and by a vertical terminal face 13*c*. The slide element 13 opposite the one shown is in abutment against the upper closed end 12*a* of bar 12 (FIG. 1).

The slide elements 13 enclosed in the lower horizontal bar cooperate, of course, with the lower closed ends 10*b*, 12*b* of bars 10 and 12.

As illustrated in FIG. 1, each bar 9 to 12 is respectively secured to two rods 18, 19, 20, 21, 22, 23, 24, 25 oriented perpendicularly to the corresponding bar and disposed parallel to the general plane of door 1. The said pairs of rods are associated with a connecting rod 26, 27, 28, 29 respectively in the form of a T of which the leg 26*a*, 27*a*, 28*a*, 29*a* cooperates with a central control bringing about simultaneous translation of the bars. The rods and connecting rods are guided in bearings in crosspieces 7. The central control is constituted by a ring gear 30 meshing with the ends of the legs of the rods 26–29 each taking the form of a rack. The ring gear is secured to an arm 31 articulated on a rack 32 meshing with a toothed sector 33 whose orientation varies as a function of the position of the handle 34 for opening the door, illustrated in dashed-and-dotted lines in FIG. 1.

Figure 2:
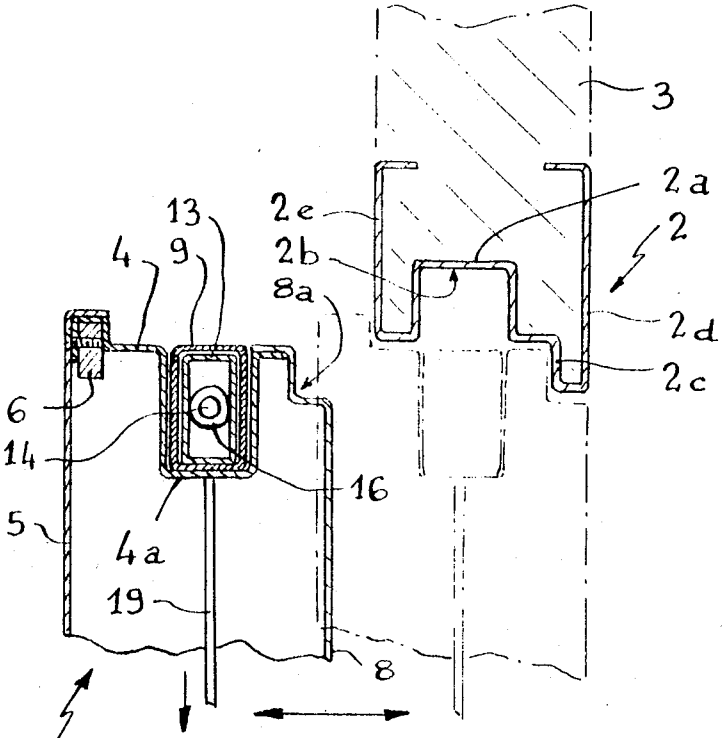
FIG. 2 illustrates in transverse section, on a larger scale, the door in open position and its frame.

Operation is as follows:

When the door is open as illustrated in FIG. 2, the different bars 9–12 are disposed in the peripheral throat 4a of the edges of the door, their ends bevelled at 45° being in abutment in two's, whilst the connecting rods 26–29 are in retracted position due to the position of the manoeuvring handle 34 of sector 33.

Figure 3:
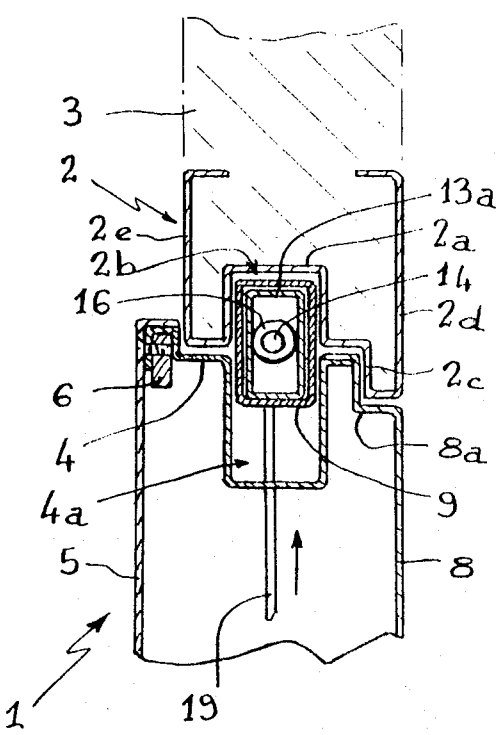
FIG. 3 is a section along III—III (FIG. 1) shown on the same scale as FIG. 2 (door closed).

When the door is closed and said handle is manoeuvred, the displacement of rack 32 brings about rotation of ring gear 30 of the opening member, with the result that the four arms of the connecting rods in the form of racks are displaced outwardly perpendicularly to each of the edges of the door. These connecting rods push the pairs of rods 18–19, 20–21, 22–23, 24–25, with the result that the corresponding bars 9–12 are displaced and come into the position of FIG. 3, i.e. they are disposed partly in throat 4a, partly in groove 2b of the door frame. The door is thus very efficiently locked. During translation of the two horizontal bars 9 and 11, the bevels 13b of slide elements 13 remain in elastic contact with the closed ends 10a–12b, 12a–12b of the vertical bars 10 and 12 until they arrive in the position of FIG. 3, with the result that the peripheral bolt presents no gap in the corners. It will be observed that, in locked position, the vertical terminal face 13c of the slide element extends flush with the outer vertical face 10c of the bar 10.

It must, moreover, be understood that the foregoing description has been given only by way of example and that it in no way limits the domain of the invention which would not be exceeded by replacing the details of execution described by any other equivalents.

What is claimed is:

1. A bolt assembly for a closure mounted within a frame wherein the frame includes horizontal and vertical grooves therein and wherein the closure includes channels in the horizontal and vertical edges thereof and which channels align with the grooves when the closure is closed with respect to the door frame, the bolt assembly comprising, a first bar means disposed within each vertical channel of the closure and a second bar means disposed within each horizontal channel thereof, said first bar means having outer ends which are bevelled at approximately 45°, a handle means, connecting rod means for operationally connecting said handle means to each of said first and second bar means so that said bar and second bar means may be selectively moved from a first position space from the grooves of the door frame to a second position within the grooves of the door frame, at least one of said second bar means including a hollow body having a pair of oppositely oriented slide elements mounted therein, each of said slide elements having outer ends which include an inclined portion which is bevelled at approximately 45°, resilient means within said hollow body for urging said slide elements outwardly thereof so that said outer ends of said slide elements will continuously abut one of said outer ends of said first bar means when said first and second bar means are moved between said first and second positions to thereby prevent the formation of any gap between said first and second bar means.

2. The bolt assembly of claim 1 including each of said second bar means including a hollow body having a pair of oppositely oriented slide elements resiliently mounted therein.

3. The bolt assembly of claim 2 in which each of said second bar means includes a pair of fixed blocks within each hollow body, a rod carried by each of said blocks, one of said slide elements being guidingly mounted to each of said rods, and said resilient means being mounted about said rods and between said fixed blocks and said slide elements.

4. The bolt assembly of claim 3 in which the outer ends of each of said slide elements include a second portion, each of said first and second bar means having an outer vertical face, said second portion of said ends of said slide elements being vertically aligned with said outer face of said first bar means when said first and second bar means are in said second position.

5. The bolt assembly of claim 1 in which said connecting rod means includes a pair of rods connected in spaced relationship to each of said first and second bar means and which extend generally perpendicularly therefrom, bearing means for supporting each of said rods in generally parallel relationship to the closure, a central control means, means for connecting said central control means to said handle means, and a plurality of T-shaped linkage means connecting each pair of said rods to said central control means.

6. The bolt assembly of claim 5 wherein said central control means includes a ring gear mounted for rotational movement with respect to the closure, and each of said T-shaped rod linkage means including end portions which are mechanically meshed with said ring gear.

* * * * *